United States Patent [19]

Ford et al.

[11] 4,381,812

[45] May 3, 1983

[54] END STRUCTURE FOR A TRAVERSE ROD

[75] Inventors: James A. Ford; Steven R. Haarer, both of Sherman Township, St. Joseph County, Mich.

[73] Assignee: Cooper Industries, Inc., Houston, Tex.

[21] Appl. No.: 298,554

[22] Filed: Sep. 2, 1981

[51] Int. Cl.[3] ..... A47H 5/032

[52] U.S. Cl. ..... 160/172

[58] Field of Search ..... 160/126, 172, 176, 345, 160/346; 16/87.2, 87.4 R, 87.6 R, 87.8 R, 94 D, 95 D, 96 D

[56] References Cited

U.S. PATENT DOCUMENTS

| | | | |
|---|---|---|---|
| Re. 26,269 | 9/1967 | Ford | 160/346 |
| 3,140,169 | 2/1979 | Arena | 160/178 |
| 3,190,346 | 6/1965 | Anena et al. | 160/172 |
| 3,273,197 | 9/1966 | Ford | 16/94 |
| 3,299,943 | 1/1967 | Poe | 160/176 |
| 3,503,434 | 3/1970 | Ford | 160/345 |
| 3,818,543 | 6/1974 | Baker, Sr. | 160/345 |
| 3,881,219 | 5/1975 | Haarer | 16/94 |
| 3,951,196 | 4/1976 | Salzmann | 160/345 |
| 3,951,197 | 4/1976 | Cohen et al. | 160/346 |
| 3,996,988 | 12/1976 | de Wit | 160/168 |

*Primary Examiner*—Peter M. Caun

*Attorney, Agent, or Firm*—Flynn, Thiel, Boutell & Tanis

[57] ABSTRACT

End structure for an elongated traverse rod having side-by-side parallel channels, one thereof opening downwardly and the other opening sidewardly. An elongated flexible element in one of the channels effects movement of a master carrier along the rod. The end structure has a pulley housing which is securable to the traverse rod by guide structure and has plural, downwardly opening compartments. A pair of pulleys are rotatably mounted on a first shaft and respectively within two of said compartments, such pulleys being engaged by the elongated flexible element. A second shaft is rotatably supported on the pulley housing and extends parallel within the other channel of said traverse rod. A drive pulley is secured to an end of the second shaft and is disposed in one of said compartments. Manually operable pulls engage the drive pulley for effecting rotation thereof.

13 Claims, 8 Drawing Figures

END STRUCTURE FOR A TRAVERSE ROD

CROSS REFERENCE TO RELATED APPLICATIONS

This application is related to copending applications filed concurrently herewith, Ser. Nos. 298,553 and 298,552.

FIELD OF THE INVENTION

This invention relates to an end structure for a traverse rod and, more particularly, relates to a type thereof having a rotatable drive mechanism for pivoting vertical blinds supported on the traverse rod and having pulleys supporting cords for effecting movement of a master carrier along the traverse rod.

BACKGROUND OF THE INVENTION

The invention disclosed herein arose out of a need to provide an inconspicuous traverse rod assembly for use in a vertical blind assembly. Most traverse rods are conspicuously mounted along the top of a window opening. Usually an attempt is made by the installer to select a color for the rod which will match the decor of the area. However, it has been and still is unlikely that a perfect color matching will be possible. Further, the problem of color matching is increased when the decor of the area is changed. Oftentimes, a painter will accidently smear paint on the traverse rod thereby causing the rod to be unsightly. Thus, it may be necessary to hide the rod by a valance or other similar device.

The problem of conspicuousness with respect to the traverse rod and the structure operable therewith to effect an operation of the vertical blinds has been solved by the structure disclosed in copending applications filed concurrently herewith, Ser. Nos. 298,553 and 298,552. This structure satisfactorily separates the mechanism for pivoting the vertical blinds about a vertical axis from the cords for moving the vertical blinds across the window opening and thereby prevents the cords from becoming snarled in the drive mechanism for pivoting the vertical blinds. However, the problem of developing a satisfactorily operable pulley housing to operably cooperate with the traverse rod and the structure operable therewith has remained a problem. Accordingly, it is desirous to solve the problem of providing a pulley housing for the traverse rod capable of effecting operation of a vertical blind assembly.

The objects of the invention include:

1. The provision of an end structure which has an overall height comparable to the height of the traverse rod and includes mechanism for effecting operation of vertical blind slats associated with the traverse rod.

2. The provision of an end structure, as aforesaid, which is easily assembled without the use of special tools and by procedures previously developed.

3. The provision of an end structure, as aforesaid, which is of a durable construction and is easily maintainable.

4. The provision of an end structure wherein a major portion of the wall structure thereof is of the same thickness to facilitate an even curing of the material following injection of the material thereof into a mold, whereby to further facilitate a maintaining of desired tolerances during the molding process.

5. The provision of pin end structures, as aforesaid, which are secured to opposite ends of the traverse rod and are mirror images of each other to thereby facilitate the alternate placement of the manually engageable pulls at either end of the traverse rod and to thereby facilitate operation of the vertical blind arrangement from either end of the traverse rod.

SUMMARY OF THE INVENTION

In general, the objects and purposes of the invention are met by providing an end structure engageable with an end of an elongated traverse rod which has two side-by-side parallel channels, one thereof opening downwardly and the other opening rearwardly. An elongated flexible element extends within one of the channels for effecting movement of a master carrier along the rod. The end structure includes a pulley housing having guide structure securable to an end of the traverse rod. Compartments are provided in the pulley housing for receiving flexible element guiding pulleys and a rotatable shaft, the axis of which extends parallel within the other channel of the traverse rod. The axis of the pulleys is generally perpendicular to the traverse rod. The end structure is secured to the traverse rod by a fastening element inconspicuously accessible through one of the channels of the traverse rod.

BRIEF DESCRIPTION OF THE DRAWINGS

Other objects and purposes of this invention will be apparent to persons acquainted with apparatus of this general type upon reading the following specification and inspecting the accompanying drawings, in which.

DETAILED DESCRIPTION

Figures 1, 7:
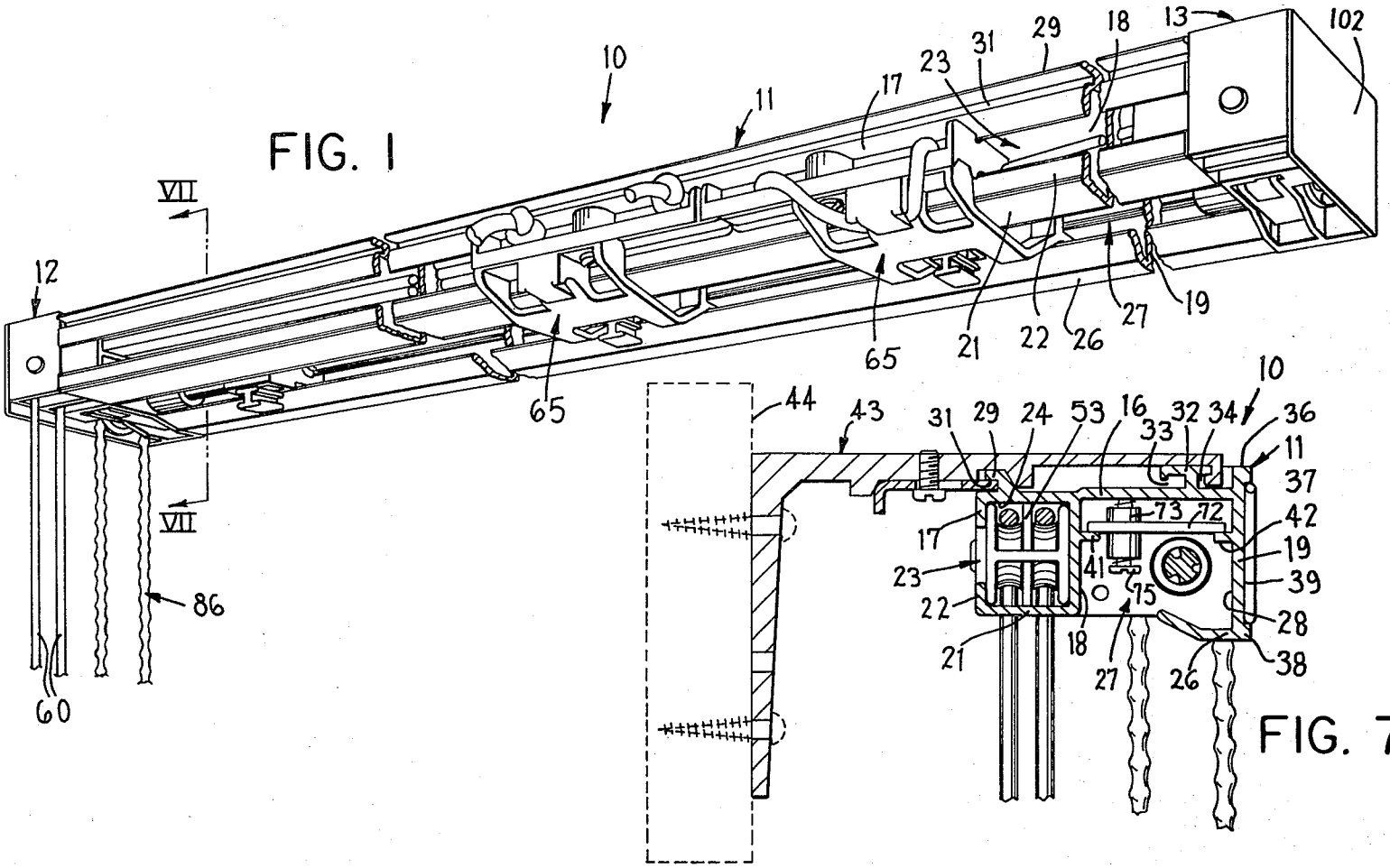
FIG. 1 is a rear perspective view of a traverse rod having on opposite ends thereof end structures embodying the invention.
FIG. 7 is a sectional view taken along the line VII—VII of FIG. 1.
Figure 5:
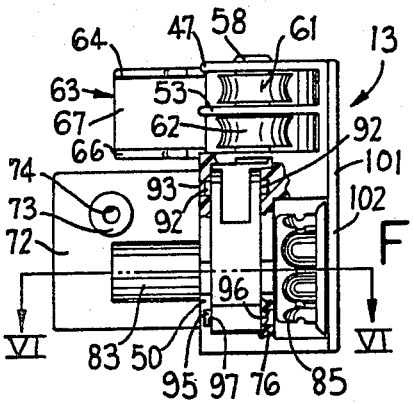
FIG. 5 is a bottom view of said end structure.
Figure 4:
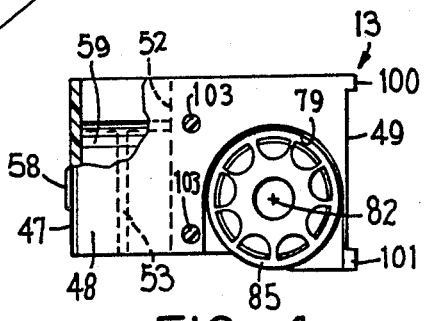
FIG. 4 is a sectional view taken along the line IV—IV of FIG. 3.

The words "up", "down", "right", "left", "front", "rear" and derivatives thereof will designate directions in the drawings to which reference is made, the "front" side of the end structure in FIGS. 4, 5 and 7 being the right side thereof. "In" and "out" and words of similar import will refer to the geometric center of the device and designated parts thereof.

A preferred embodiment of the traverse rod assembly disclosing the invention is illustrated in FIG. 1. The traverse rod assembly includes an elongated traverse rod 11 and a pair of end structures 12 and 13 on opposite ends thereof. The features of the end structures 12 and 13 are the subject matter of the invention disclosed herein. The structure of the traverse rod and the cooperation of the master carrier and sliders with each other and with other structure on the traverse rod are the subject matter of the aforementioned two copending applications filed concurrently herewith. The one copending application Ser. No. 298,553 is entitled MASTER CARRIER FOR A TRAVERSE ROD and the other application Ser. No. 298,552 is entitled TRA- VERSE ROD FOR A VERTICAL BLIND. The disclosures in these two applications are incorporated by reference herein.

For convenience, however, the traverse rod 11 (FIG. 7) is described as having a top wall 16 and downwardly extending and transversely spaced rear wall 17, middle wall 18 and front wall 19. A substantially horizontal bottom wall 21 is integrally connected to the middle wall 18 at the bottom thereof and terminates in an upwardly extending rear flange 22 coplanar with the wall 17. The upper edge of the flange 22 and the lower edge of the rear wall 17 define an opening or slot 23 into a channel 24 defined by the top wall 16, the walls 17, 18 and 21, and the flange 22. A substantially horizontal flange 26 is integrally connected to the bottom edge of the front wall 19 and extends rearwardly toward, but terminates short of, the middle wall 18 to define an opening or slot 27 into a channel 28 defined by the flange 26, the front wall 19, the top wall 16 and the middle wall 18.

An elongated, integral rib 29 extends upwardly from the top wall 16 adjacent the plane containing the rear wall 17 and has a rearwardly opening recess 31 therein. The elongated rib 32 extends upwardly from the top wall intermediate the plane containing the middle wall 18 and the front wall 19 and has a rearwardly opening recess 33 and a frontwardly opening recess 34. The rib 36 extends upwardly in generally the same plane as the front wall 19 and has a flange 37 extending forwardly of the plane containing the front wall 19. A small flange 38 extends forwardly of the front wall 19 in the plane of the bottom wall 26. The flanges 37 and 38 define a trough 39.

A pair of inwardly projecting and coplanar flanges 41 and 42 are provided in the channel 28 approximately one-third of the way down from the top wall 16.

A conventional type of wall mounted bracket 43 can be used to secure the traverse rod 11 to an upstanding wall 44. Alternatively, a similar bracket (not illustrated) can be utilized for securing the traverse rod to the ceiling. Both types of brackets are generally illustrated in U.S. Pat. No. 3,273,197 and reference thereto is incorporated herein.

The end structure 13 (FIGS. 2 to 6) is a mirror image of the end structure 12 and, therefore, a detailed description of end structure 13, only, will be given herein. The end structure 13 comprises a pulley housing 46 having a generally rectangular shape with a top wall 45, side walls 48 and 50 and end walls 47 and 49. The side walls 48 and 50 extend parallel to each other away from the end wall 49 but the side wall 50 terminates short of the end wall 47 to define a space 51 therebetween. An upright wall 52 is integral with and extends between the side walls 48 and 50 approximately one-third of the way from the end wall 47 toward the end wall 49. This side wall 50 effectively abuts the end of the rod 11 when the end structure 13 is mounted thereon. An upright wall 53 is integral with the side wall 48 and extends between the end wall 47 and the upright wall 52. The walls 47, 52 and 53 are parallel to each other and define therebetween the compartments 54 and 56. Axially aligned openings 57 are provided in the walls 47, 52 and 53 and are adapted to receive an axle 58 therein.

A pulley 61 is received into the compartment 54 and is rotatably supported on the axle 58. A pulley 62 is received into the compartment 56 and is rotatably supported on the axle 58. The pulleys 61 and 62 guide the cords 60 which are conventionally operatively connected to the master carriers 65.

The wall 53 is flush at the bottom edge thereof with the bottom edge of the walls 47 and 52. However, the upper edge of the wall 53 terminates at a height less than the height of the walls 47 and 52 as illustrated in broken lines in FIG. 4. The upper edge of the wall 53 is connected to the mutually facing sides of the walls 47, 48 and 52 by an arcuate wall section 59 having a center point coinciding with the axis of the axle 58.

Figure 2:
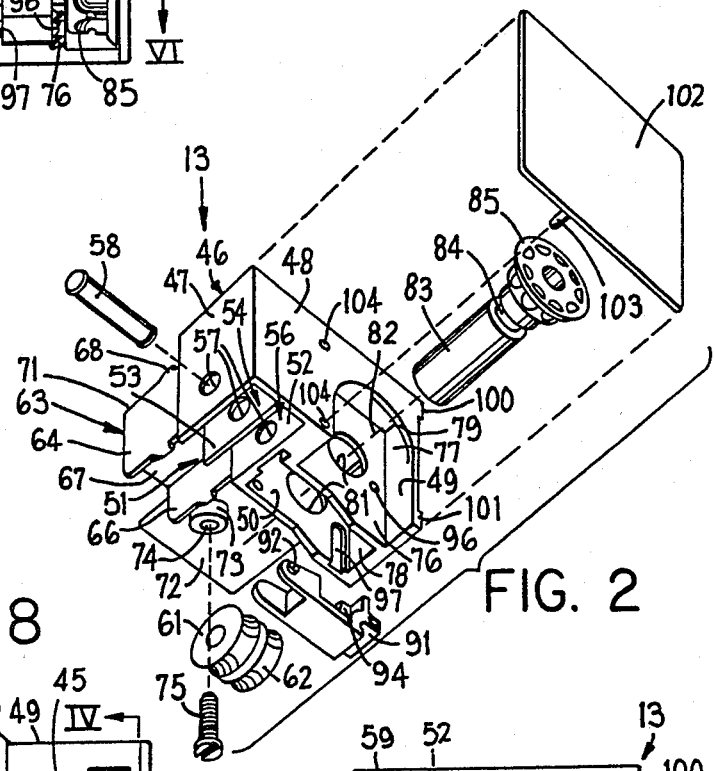
FIG. 2 is an exploded, bottom perspective view of an end structure embodying the invention.
Figure 3:
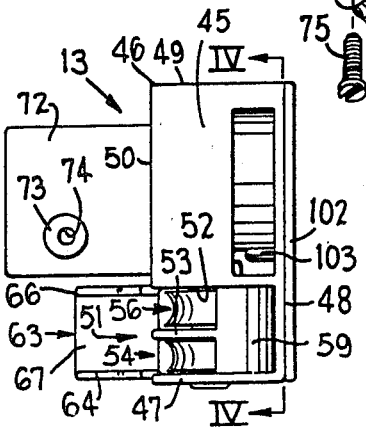
FIG. 3 is a top plan view of said end structure.

An H-shaped guide 63 (FIG. 2) is integrally secured to the walls, 47, 52 and 53 on a side thereof remote from the side wall 48. More specifically, the H-shaped guide 63 has a pair of upstanding side walls 64 and 66 and an interconnecting bight 67 intermediate the height of the side walls 64 and 66. The side walls 64 and 66 are substantially an extension of the end wall 47 and the upright wall 52, respectively. The lateral spacing, however, between the side walls 64 and 66 is slightly less than the lateral spacing between the end wall 47 and the upright wall 52. This is best illustrated in FIGS. 3 and 5. The spacing between the outside surfaces of the side walls 64 and 66 is preferably just slightly less than the spacing between the rear walls 17 and 22 and the middle wall 18 as shown in FIG. 7 to facilitate reception in the channel 24.

The bight 67 (FIG. 2) is integrally connected to the upright wall 53 and is the only portion of the H-shaped guide so connected to the upright wall 53. The bight 67 is located intermediate the height of the side walls 64 and 66 and is preferably midway between the top and bottom edges of the upright wall 53. In this particular embodiment, the bight 67 is contained in the same plane as is the axis of the axle 58.

Figure 8:
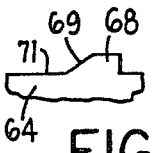
FIG. 8 is an enlarged fragment of an H-shaped guide on said end structure.

The top and bottom edges of the side walls 64 and 66 of the H-shaped guide 63 have identical upstanding tabs 68 thereon. Referring to FIG. 8, the tab 68 has a ramp portion 69 extending from the top edge 71 of the wall 64. The purpose of this ramp will be explained below. The height of the side walls 64 and 66 is preferably slightly less than the vertical spacing between the top wall 16 and the bottom wall 21 to additionally facilitate a snug reception of the H-shaped guide 63 therein as further shown in FIG. 7.

The pulley housing 46 additionally includes a platelike guide 72 (FIGS. 2 and 3) extending from the side wall 50 in a direction parallel to the bight 67 of the H-shaped guide 63. The platelike guide 72 has a cylindrical boss 73 extending from both the top and bottom surfaces thereof. An opening 74 extends through the boss 73 and is adapted to receive a screw 75 therein. The positioning of the guide 72 on the side wall 50 is best illustrated in FIG. 7. The spacing is such that the guide 72 will rest on the upper surface of the flanges 41 and 42 so that when the screw 75 is threadedly received into the opening 74 in the boss 73, the end of the screw will engage the underside of the top wall 16 of the traverse rod 11 to urge the guide 72 into a snug engagement with the flanges 41 and 42. The head of the screw 75 is accessible through the opening 27 in the channel 28 of the traverse rod.

The pulley housing 46 has an upright wall 76 integral with and extending between the upright wall 52 and the end wall 49 and parallel to and equidistant from the side walls 48 and 50. The side wall 48, the end wall 49 and the upright walls 76 and 52 define a compartment 77. In addition, the side wall 50, the end wall 49 and the upright walls 76 and 52 define a compartment 78. Compartments 77 and 78 are closed off at the top and open downwardly as best illustrated in FIG. 2. The side wall 48 has an arcuately shaped access opening 79 providing access to the compartment 77 in a direction perpendicular to the side wall 48. A pair of axially aligned openings 81 are provided in the upright wall 76 and the side wall 50 and have an axis 82 (FIG. 4) that is colinear with the axis of the arcuate access opening 79.

Figure 6:
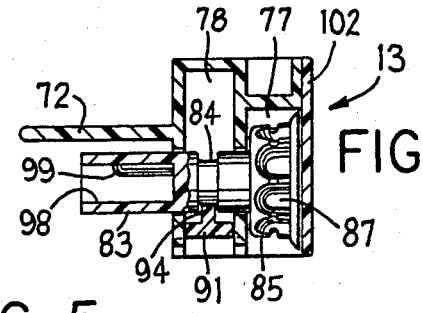
FIG. 6 is a sectional view taken along the line VI—VI of FIG. 5.

An elongated axle or shaft 83 is received into the axially aligned openings 81 and is rotatably supported therein. The axle 83 has an annular groove 84 in the periphery thereof, which annular groove 84 is located in the compartment 78 as shown in FIG. 6. The axle 83 has a pulley 85 secured on one end thereof and located in the compartment 77 upon assembly and as shown in FIG. 6. The pulley 85 has plural pockets around the periphery thereof adapted to engage a beaded strand 86. That is, the beads embodied within the strand are sequentially received in the individual pockets 87 so that, as the beaded strand 86 is pulled in one direction, the beaded strand will function to rotate the pulley and thereby rotate the axle 83.

A locking member 91 is pivotally secured to the pulley housing 46 through buttonlike members 92 on the locking member 91 being received into holes 93 in the opposing surfaces of walls 50 and 76, as illustrated in FIG. 5. In other words, the locking member 91 is pivotable about the axis of the buttons 92. The locking member 91 has a rib or flange 94 thereon which is received into the annular groove 84 on the axle 83 when the locking member 91 is in the closed position illustrated in FIGS. 5 and 6. The locking member 91 is held in its locked position by further buttonlike members 95 being received into a hole 96 in the wall 76 and in an elongated slot 97 provided in the wall 50.

In this particular embodiment, the axle 83 has an opening 98 in one end thereof and has a key 99 fixedly disposed therein.

The end wall 49 has a pair of flanges 100 and 101 at the upper and lower edges thereof which project in a direction perpendicularly frontwardly away from the plane of the end wall 49. These flanges are colinear with the flanges 37 and 38, respectively, on the traverse rod 11 and thus define a continuation of the trough 39.

An elongated strip of fabric can, if desired, be adhesively secured to the front facing surface of the trough 39, namely, the front side of the front wall 19 and the front side of the wall 49. The fabric would preferably match the fabric of the drapery material or vertical blind material.

A cover plate 102 is provided having plural prongs 103 thereon which are receivable into openings 104 in the side wall 48 of the pulley housing 46. The end plate 102 effectively closes off the arcuate opening 79 to close off access to the pocketed pulley 85 as best shown in FIG. 1.

The pulley housing is preferably made of thermoplastic material and has a generally uniform wall thickness over the major portion thereof. This uniform wall thickness facilitates an even curing of the material following the injection of the material into a mold thereby maintaining desired tolerances.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An end structure engageable with the end of a traverse rod having two side-by-side parallel channels, one thereof opening downwardly and the other opening sidewardly, and an elongated flexible element in one of said channels for effecting movement of a master carrier along said rod, comprising:

a pulley housing having guide means on one side thereof securable to said traverse rod adjacent one end thereof, said pulley housing having plural, downwardly opening compartments therein, a first said compartment also opening in an endwise direction and on the side of said pulley housing remote from said guide means;

said guide means having first and second parts, each part being axially aligned with and slidably received into a respective one of said side-by-side channels;

fastener means for effecting a fixed connection of said pulley housing to said traverse rod;

second and third said compartments opening in an endwise direction toward said traverse rod;

first shaft means extending at a right angle to the longitudinal axis of said traverse rod and extending through said second and third compartments;

a pair of pulleys rotatably mounted on said first shaft means and respectively within said second and third compartments, said pair of pulleys being engaged by said elongated flexible element;

second shaft means rotatably supported on said pulley housing and extending parallel to said longitudinal axis of said traverse rod;

a drive pulley fixedly secured to an end of said second shaft means and being received in said first compartment;

manually operable means drivingly engaged with said drive pulley for effecting rotation thereof;

said second shaft means being axially slidably received in aligned openings in interior walls with at least one thereof defining said first compartment, said openings being accessible through said endwise opening in said first compartment; and said pulley housing including a fourth compartment adjacent said first compartment, said fourth compartment having a locking member mounted therein and engaging said second shaft means to prevent axial movement thereof while simultaneously permitting rotation thereof.

2. The end structure of rib, wherein said second shaft means includes means defining an annular groove thereon oriented in said fourth compartment; and wherein said locking member includes a rib member, said annular groove and said rib being radially aligned with said rib being received in said annular groove to prevent said axial movement of said second shaft means while permitting said rotation thereof.

3. The end structure of claim 2, wherein said locking is pivotally secured to said pulley housing member about an axis parallel to the axis of rotation of said second shaft means, said locking member and an interior wall surface of said fourth compartment therein having cooperating locking means thereon holding said rib in said annular groove.

4. The end structure of claim 3, wherein said cooperating locking means includes means defining a hole in said interior wall surface of said fourth compartment and projection means on said locking member remote from said pivot support therefor, said hole being arcuately aligned with the path of movement of said projection means, said projection means being received in said hole when said rib enters said annular groove.

5. The end structure of claim 1, wherein said second shaft means includes means defining a hole in the end thereof remote from said drive pulley.

6. The end structure of claim 1, wherein said second and third compartments include laterally spaced walls having means thereon defining axially aligned holes, said first shaft means being received in said axially aligned holes to rotatably support said elongated flexible element engaging pulleys.

7. The end structure of claim 1, wherein said pulley housing is made of a thermoplastic material and has a generally uniform wall thickness over a major portion thereof to facilitate an even curing of said material following an injection of said material into a mold and to maintain desired tolerances.

8. The end structure of claim 1, including an end cover and securement means for effecting a securement of said end cover to said pulley housing to close said endwise opening of said first compartment.

9. In combination, an elongated traverse rod having first and second side-by-side parallel channels extending lengthwise thereof, each channel communicating with an elongated slot, and a pulley end structure mounted on at least one end of said rod, said end structure comprising:

a one-piece pulley housing having first and second spaced and substantially parallel side walls and first and second substantially parallel and spaced end walls;

said pulley housing including first and second interior walls disposed in spaced and parallel relationship to one another and in spaced and parallel relationship to said first end wall so as to define within said housing first and second compartments which are disposed in side-by-side relationship, said first and second compartments both opening downwardly of said housing and also opening sidewardly through said first side wall for communication with said first channel;

first shaft means supported on said pulley housing and extending through said first and second compartments substantially at a right angle to the longitudinal axis of said traverse rod;

first and second rotatable pulleys mounted on said first shaft means and respectively positioned within said first and second compartments, said first and second pulleys being engageable by an elongated flexible element which extends into said first channel;

said pulley housing having first and second guide means integrally fixed thereto and projecting outwardly away from said first side wall, said first and second guide means being respectively slidably received within said first and second channels so that said first side wall is positioned directly adjacent and substantially abuts the free end of said rod;

fastener means associated with one of said guide means for fixedly connecting said pulley housing to said traverse rod;

second shaft means rotatably supported on said pulley housing and disposed with its rotational axis extending substantially parallel to the longitudinal axis of said traverse rod and in alignment with said second channel, said second shaft means having one end thereof rotatably supported on and projecting through said first side wall so that said one end of said second shaft means is in communication with said second channel, said one end of said second shaft means defining thereon a rotatable driving portion which is adapted for nonrotatable engagement with an elongated shaft which is positionable within and extends through said second channel;

said pulley housing defining therein a third compartment which is disposed adjacent one of said side walls and opens downwardly of said housing, said second shaft means projecting into said third compartment; and a third pulley positioned within said third compartment and nonrotatably and coaxially secured to said second shaft means, said third pulley being engageable with manually operable means for effecting rotation of said second shaft means.

10. A combination according to claim 9, wherein said third compartment is disposed directly adjacent and opens endwise through said second side wall for permitting said second shaft means to be axially slidably inserted into said pulley housing, and a cover plate removably attached to said pulley housing for closing the opening in said second side wall.

11. A combination according to claim 10, wherein said pulley housing includes an interior divider wall which is spaced between and substantially parallel with said first and second side walls, said third compartment being defined between said divider wall and said second side wall, a fourth compartment being defined between said first side wall and said divider wall, and a locking member movably supported on said pulley housing and positioned within said fourth compartment, said locking member being engageable with said second shaft means to prevent axial movement thereof while simultaneously permitting rotation thereof.

12. A combination according to claim 9, wherein said second guide means includes a platelike part which is integrally fixed to and projects perpendicularly outwardly from said second side wall, said platelike part projecting into said second channel, and said fastener means including a threaded fastener mounted on said platelike part for locking engagement with said rod, said driving portion of said second shaft means projecting outwardly a selected distance beyond said first side wall and being positioned below said platelike part.

13. A combination according to claim 12, wherein said first guide means is substantially H-shaped in cross section and has side legs which effectively constitute extensions of the outer side walls of the first and second compartments, said first guide means being snugly slidably disposed within said first channel.

* * * * *

UNITED STATES PATENT AND TRADEMARK OFFICE

CERTIFICATE OF CORRECTION

PATENT NO. : 4 381 812

DATED : May 3, 1983

INVENTOR(S) : James A. Ford and Steven R. Haarer

It is certified that error appears in the above-identified patent and that said Letters Patent is hereby corrected as shown below:

Col. 6, line 51; change "rib" to ---Claim 1---.

Col. 6, line 54; change "rib member" to ---rib---.

Col. 6, line 60; change "locking" to ---locking member---.

Col. 6, line 61; change "housing member" to ---housing---.

Signed and Sealed this

*Sixteenth* Day of *August 1983*

[SEAL]

*Attest:*

GERALD J. MOSSINGHOFF

*Attesting Officer*

*Commissioner of Patents and Trademarks*